United States Patent [19]

Kane

[11] Patent Number: 4,894,627

[45] Date of Patent: Jan. 16, 1990

[54] DIRECTIONAL WAVEGUIDE-FINLINE COUPLER

[75] Inventor: Robert C. Kane, Woodstock, Ill.

[73] Assignee: Motorola, Inc., Schaumburg, Ill.

[21] Appl. No.: 292,980

[22] Filed: Jan. 3, 1989

[51] Int. Cl.[4] ..... H01P 5/18

[52] U.S. Cl. ..... 333/113; 333/26

[58] Field of Search ..... 333/113, 114, 21 R, 333/26, 33, 34, 116

[56] References Cited

U.S. PATENT DOCUMENTS 3,914,713 10/1975 Konishi et al. ..... 333/21 R 4,575,701 3/1986 Greed ..... 333/21 R X

*Primary Examiner*—Paul Gensler

*Attorney, Agent, or Firm*—Joseph P. Krause

[57] ABSTRACT

A waveguide coupler for coupling energy from one waveguide to another, using a finline mode coupler. The coupler use a mode converter which changes the propagation mode in a waveguide from waveguide mode to finline mode. Finline mode waves are coupled into an adjacent waveguide via a slot in a wall, common to both waveguides wherein lies a finline coupler. After the finline mode waves are coupled into the adjacent waveguide, the finline mode converter reconverts the finline mode propagation to waveguide mode.

9 Claims, 2 Drawing Sheets

FIG. 1
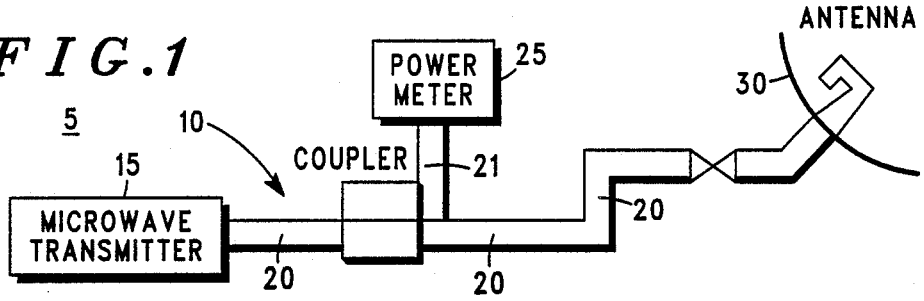
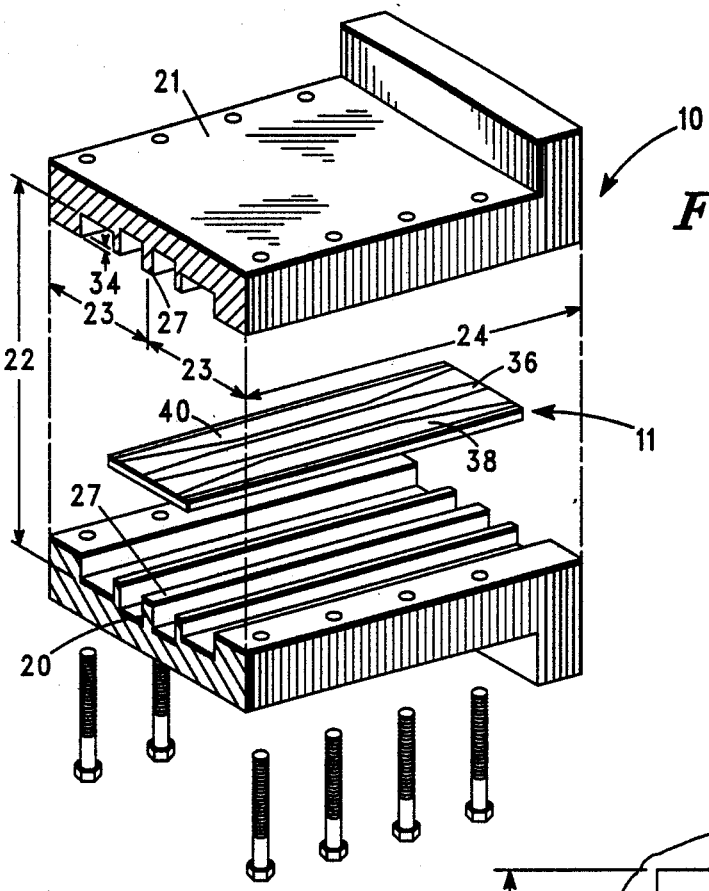
FIG. 2
FIG. 3
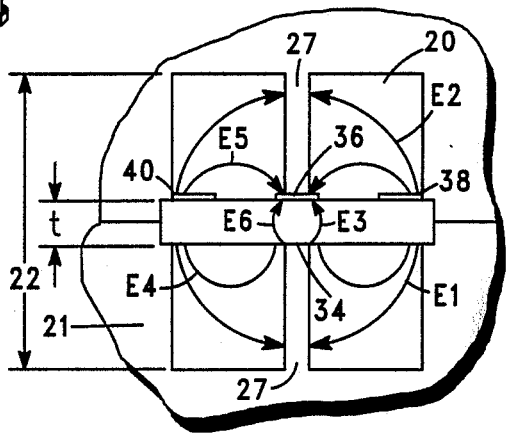

DIRECTIONAL WAVEGUIDE-FINLINE COUPLER

BACKGROUND OF THE INVENTION

This invention relates to cylindrical waveguides. More specifically, this invention is a waveguide coupler used to couple a portion of the energy propagated through one waveguide into another waveguide.

It is frequently necessary to sample the signal being transmitted through a waveguide, for example, to measure standing wave ratios or output power from a transmitter. Prior art waveguide couplers coupled radio frequency energy in one waveguide into an adjacent waveguide by physically placing two rectangular waveguides together so that the walls of the two waveguides in contact form a common wall through which slots or apertures are cut at predetermined intervals to permit electromagnetic energy in one waveguide to radiate into the other waveguide. The slots or apertures cut in the common wall of the two waveguides generally have predetermined geometries that permit energy transfer from a first waveguide into a second waveguide such that directional wave propagation will occur in the second waveguide. These spaced apertures or openings require close machining tolerances and precise spacing to accomplish an efficient energy transfer from one waveguide to the next.

Frequency dependency constitutes another problem with prior art couplers. Apertures of any given size and spacing permit more coupling at higher frequencies than they do at lower frequencies. When employed in broadband applications, a coupler, using spaced apertures, will couple different frequencies, at different levels.

Spaced apertures might also exhibit two-directional signal propagation in the coupled waveguide, when the slots or apertures are not spaced ¼ of the wavelength of the coupled signal (i.e. signals in the coupled waveguide might propagate in both directions). This bidirectional coupling occurs when wavefronts in the coupled waveguide do not properly add in the desired direction and the wavefronts in the coupled waveguide do not properly cancel in the opposite direction, all because of inexact slot spacing.

When one waveguide is used across a relatively wide range of frequencies, the level of coupling might change substantially from one end of the frequency range to another when using only a single set of apertures for the coupler. When using spaced aperture couplers with a waveguide that carries signals across a relatively wide frequency range, it is frequently necessary to cascade many pairs of coupling apertures, each optimized for small segments of the frequency range. An alternative is to cascade separate frequency couplers, with each coupler being optimized for a frequency band. Of course a disadvantage of having to cascade several spaced aperture couplers in a waveguide system is the added cost, weight, and complexity of the transmission line. A waveguide coupler which is inherently less frequency dependent and easier to fabricate would be an improvement over the prior art.

SUMMARY OF THE INVENTION

The present invention provides a waveguide coupler that does not use spaced apertures cut between adjacent waveguide walls thereby eliminating the associated frequency-dependent transfer characteristics and precision machining requirements of prior art couplers. This waveguide coupler nevertheless provides a substantially flat frequency response across a relatively wide range of operating frequencies.

In one embodiment, the invention provides a waveguide coupler for coupling a portion of a signal in one waveguide, hereafter referred to as the source waveguide, into an adjacent waveguide, hereafter referred to as the coupled waveguide, both waveguides sharing a common wall. The coupler is comprised of a waveguide-mode-to-finline-mode converter that converts TE or TM waves or waveguide mode propagation signals to fin-line-mode waves. After energy in the source waveguide is converted to fin line mode, a portion of the energy is transferred from the source waveguide to a coupled waveguide through a single aperture, which is a slot cut through the common wall separating the two waveguides and orthogonal to the cross-section of the two waveguides. A fin line pair is located in the aperture and is the mechanism by which energy in the source waveguide is transferred to the coupled waveguide.

Energy propagating in the source waveguide is transferred across the aperture in fin line mode. The transferred energy in the coupled waveguide in the fin line mode may be reconverted from fin line mode to waveguide mode whereupon the propagation of electromagnetic energy through the waveguide continues in waveguide mode. Electromagnetic energy in the source waveguide after being converted into fin line mode and after traversing the fin line coupling mechanism in the common waveguide wall may also be converted back to waveguide mode from fin line mode whereupon microwave energy continues to propagate through the waveguide normally. The coupler is directional in that energy in the coupled waveguide propagates in only a single preferred direction.

The degree of tightness of coupling from the source waveguide to the coupled waveguide is controlled by the dimensions of the fin line mode coupler, the physical dimensions of the slot in the waveguide wall, and the length of the coupler in the waveguide. Coupling coefficients can be empirically determined to fix the desired ratio of input power to coupled power for any particular waveguide and geometry.

BRIEF DESCRIPTION OF THE DRAWINGS

FIG. 1 shows a microwave transmission system including a transmitter, waveguide coupler, and antenna.

FIG. 2 shows an isometric cross-sectional view of the waveguide coupler.

FIG. 3 shows representative electric field lines in the waveguide coupler of FIG. 2.

DETAILED DESCRIPTION OF THE PREFERRED EMBODIMENT

Figure 4:
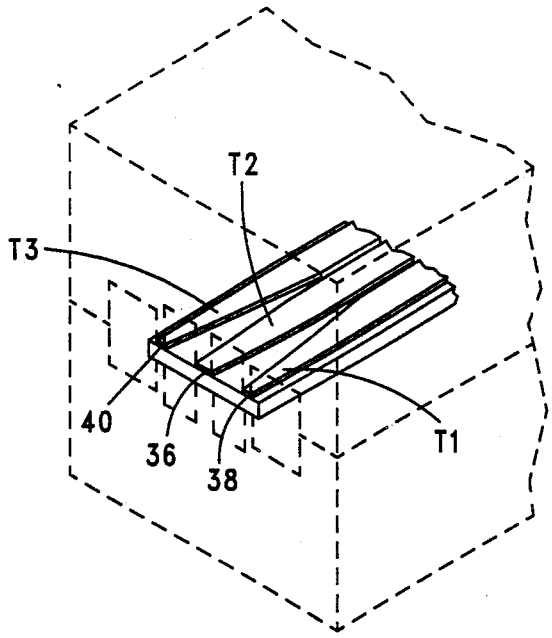
FIG. 4 shows an isometric, cross-sectional view of the invention with the fin line mode coupler including smooth shaped mode converter transition regions.

Referring to FIG. 1 there is shown a simplified microwave transmission system 5. A microwave transmitter 15 delivers microwave energy through waveguide 20 to an antenna 30. A meter 25 shows what power levels are delivered through waveguide 20 to antenna 30.

Meter 25 measures the level of power propagating in waveguide 20 by means of coupler 10, which couples a percentage of the power propagating through waveguide 20 into waveguide 21. The energy coupled into waveguide 21 propagates to power meter 25. By means of coupler 10, a small, predetermined percentage of power propagating through waveguide 20 is diverted into waveguide 21 and to power meter 25 such that power meter 25 can be calibrated to reflect actual conditions in waveguide 20 by scaling the readings of meter 25.

Referring now to FIG. 2, there is shown an isometric cross-sectional view of coupler 10 shown in FIG. 1. Coupler 10 is comprised of two adjacent parallel waveguide sections 20 and 21, each having a predetermined length 24 and each having a wide dimension 22 that is at least equal to one-half the wave length of the lowest frequency signal propagating in the waveguide 20. Those skilled in the art will recognize that wide dimension 22 must be at least equal to one-half the longest wavelength propagated through waveguide 20 to permit energy propagation through the waveguide.

Microwave energy propagating in waveguide 20 is coupled into the adjacent waveguide 21 by means of a fin line structure 11, described below and shown in FIG. 5, inserted into waveguides 20 and 21 through the slot 34, cut through the waveguides' common wall 27. In the preferred embodiment, slot 34 is cut through the common wall 27, in a direction orthogonal to the cross-sections of waveguides 20 and 21. (One-half of slot 34 shown in FIG. 3 is shown by the depth of the chamfer 34' shown in FIG. 2). The width of slot 34 is adjusted, along with the length 24 of the coupler 10 and the spacing of conductors of the finline structure 11, (as shown in FIG. 5) to determine the degree of coupling between the two waveguides 20 and 21.

Figure 5:
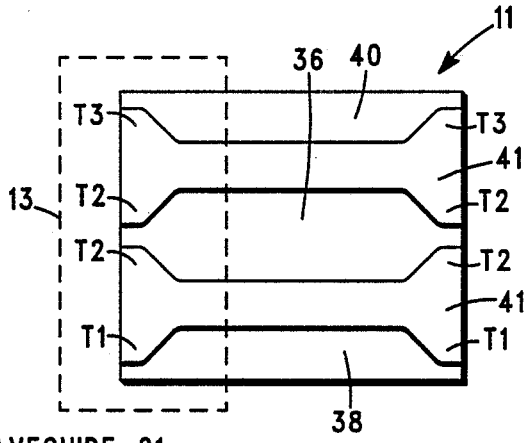
FIG. 5 shows a top view of the fin line mode coupler used in the invention including mode converter sections on each end.

With reference to FIG. 5, a fin line mode structure 11 is inserted into the common wall section 27 of coupler 10. Fin line mode structure 11 is comprised of conductors 36, 38 and 40 on a non-metallic substrate 41. The portions T1, T2, and T3 of fin line mode structure 11, of conductors 36, 38 and 40, comprise a fin line mode converter 13, which transform the wave propagating through waveguide 20 from waveguide mode to fin line mode. Electromagnetic fin-line-mode waves propagating through coupler 10 produce electric fields across conductors 38 and 36 which in combination with the slot 34 located in common wall 27 of waveguides 20 and 21, effects the transfer of energy from waveguide 20 into 21. Energy transfer is accomplished by means of the electric field set up along the length of the common fin line conductor 36 across the common wall aperture.

Referring now to FIG. 3, there is shown a cross sectional diagram of the electric field that would exist in coupler 10 as shown in FIGS. 1 and 2. Electromagnetic energy propagating in waveguide 20 is first converted from waveguide mode to fin line mode along the transition regions, T1, T2 and T3 of conductors 36, 38 and 40 to produce the electric field lines E1, E2 and E3 of FIG. 3. Electric field lines are shown originating from conductor 38 and terminating at center conductor 36 in waveguide 20. However, the reverse polarity may equally represent the field pattern. The slot 34 cut through the common wall 27 of waveguide 20 and 21 permits the development of electric field lines E3 and E6 from the common wall 27 across slot 34 to the center conductor 36 as shown. The termination of flux across the slot 34 to conductor 36 establishes an electric field distribution in waveguide 21 that is similar to the electric field distribution as shown in FIG. 3. Electric field lines E4 and E5 in waveguide 21 are shown originating from conductor 40 and terminating on the center conductor 36. Electric field lines E6 originate at center wall 27 and terminate at center conductor 36 of the fin line mode structure 11. The reverse polarity may equally represent the field pattern. The development of the electric field in waveguide 21 is accomplished by means of the fin line coupling mechanism located in slot 34 in the common wall 27. The transfer of fin line mode microwave energy through the slot 34 establishes electric fields in waveguide 21. In the absence of the fin line coupling mechanism, no energy transfers through the slot 34 in the common wall 27.

Note that when energy is transferred into waveguide 21 across the slot 34, the energy transferred into waveguide 21 propagates in the same direction as the direction of propagation in waveguide 20. There is little energy propagated in the opposite direction as is seen with multi-aperture couplers because coupling is accomplished by common field effects rather than aperture radiation.

The strength of the electric fields and correspondingly the amount of coupling, (i.e., the amount of power delivered into waveguide 21 from waveguide 20), is dependent upon the spacing of conductors 36, 38 and 40, the width of the slot 34 and the overall length 24 of the fin line coupler 10. Those skilled in the art will recognize that as the spacing between conductors 36, 38 and 40 becomes smaller the density of the electric field lines will increase accordingly. Increased density of the fields about the gap between conductors 36, 38 and 40 permits more power to be transferred through the slot 34. Conversely, increasing the width of the slot 34 in the common wall 27 increases the coupling by permitting an increased portion of the total field to span slot 34. Also, asymmetrically locating the gaps between conductors 36, 38 and 40, closer to the common wall 27, increases the coupling level.

Referring to FIG. 4 there is shown another isometric cross-sectional view of the coupler 10 of the present invention. The conductors 36, 38 and 40 are shown with transition regions T1, T2 and T3 which in the preferred embodiment are cosine$^2$ tapers of metal sections deposited onto a dielectric substrate. The transition regions T1/T2 and T2/T3 respectively perform the waveguide mode to fin line mode conversion enabling the coupling to take place along the fin line coupler which is formed by the remainder of conductors 36, 38 and 40, beyond the tapered transition region. Similar wave shapes for the transition regions might include sine squared, linear, logarithmic or other mathematical functions. In the preferred embodiment, the thickness (t, as shown in FIG. 3) of the dielectric upon which the fin line mode coupler was deposited is selected so as to hold electrical conductor 36 in contact with common wall 27.

Referring again to FIG. 5 there is shown a top view of the fin line mode structure 11 of the invention. Transition regions T1, T2 and T3, included at both ends of conductors 36, 38 and 40, are shown that accomplish the waveguide mode to fin line mode conversion along a predetermined length of the coupler and also include a similar set of transition regions T1, T2 and T3 to perform a fin line mode to waveguide mode conversion, enabling propagation through the waveguide to continue normally as it had in the waveguide ahead of the coupler 10. Conductors 36, 38 and 40 cannot merely be suspended in the waveguides 20 and 21 as shown in FIGS. 1, 2, and 3 for illustrative purposes but must be held fixed relative to the aperture. Conductors 36, 38 and 40 are deposited onto a dielectric material such as Duroid TM or G-10 and positioned appropriately in the two adjacent waveguides 20 and 21 as shown in FIGS. 1, 2 and 3. In the preferred embodiment electrodes 36, 38 and 40 are deposited on Duroid TM, manufactured by the Rogers corporation, the thickness of which when inserted into the waveguide 20 and 21 holds conductor 36 in electrical contact with the waveguide common wall 27 and maintains the slot 34 as shown in FIG. 3.

Figure 6:
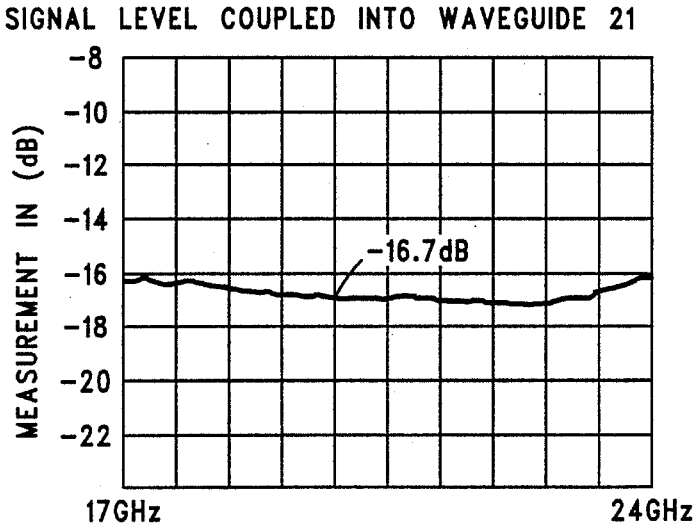
FIG. 6 shows a graph of the frequency dependency of the output of the coupler of the preferred embodiment from 17 gigahertz to 24 gigahertz.

In the preferred embodiment a directional fin line coupler is used in a waveguide operated from 17 gigahertz to 24 gigahertz. Test results of the energy coupled by the waveguide coupler of the invention as shown in FIG. 6 show that across this 7 gigahertz frequency range the amount of coupling from waveguide 20, to waveguide 21 changed less than 2 decibels. The coupling from waveguide 20 to waveguide 21 at 17 gigahertz was approximately −16 dB, while at 24 gigahertz the coupling remained at essentially −16 dB dropping to approximately −17 dB somewhere between 17 and 24 gigahertz as shown.

What is claimed is:

1. A directional energy coupler for transferring radio frequency energy traveling in a first waveguide to an adjacent second waveguide, said first and second waveguides having substantially rectangular cross-sections, and a common wall separating said waveguides said coupler comprised of:

first mode converter means for converting waveguide-mode radio-frequency energy in said first waveguide to finline-mode radio-frequency energy in said first waveguide; and, energy coupling means for coupling finline-mode radio-frequency energy from said first mode converter means in said first waveguide to finline-mode radio-frequency energy in said second waveguide, said energy coupling means being a single elongated slot oriented with its widest dimension orthogonal to said waveguide cross-sections, said slot separating said common wall into first and second sections.

2. The directional energy coupler of claim 1, including second mode converter means, coupled to said energy coupling means for converting finline-mode radio-frequency energy in said first waveguide to waveguide-mode radio-frequency energy in said first waveguide.

3. The directional energy coupler of claim 2, including a third mode converter means for converting finline-mode radio-frequency energy in said second waveguide to waveguide mode energy in said second waveguide.

4. The directional energy coupler of claim 1, wherein said finline mode energy in said second waveguide travels substantially in a single predetermined direction.

5. The directional energy coupler of claim 1, wherein said waveguide-mode radio-frequency energy in said second waveguide travels substantially in a single predetermined direction.

6. The directional energy coupler of claim 1 wherein the energy coupled into said second waveguide is a fractional amount of the energy in said first waveguide.

7. The directional energy coupler of claim 1, wherein said first mode converter means includes a first metallic substantially planar surface, having a predetermined length and lying in contact with only said first section of said common wall.

8. The directional energy coupler of claim 7, wherein said first mode converter means is further comprised of second and third metallic surfaces in said first and second waveguides, said second and third metallic surfaces being substantially co-planar with said first metallic planar surface, electrically isolated from said first metallic planar surface and electrically in contact with waveguide walls other than said common waveguide wall, of said first and second waveguides.

9. The directional energy coupler of claim 8 wherein said first, second, and third metallic surfaces include transition regions shaped to substantially conform to a predetermined mathematical function.

* * * * *